US006966473B1

(12) United States Patent
Hayden

(10) Patent No.: US 6,966,473 B1
(45) Date of Patent: Nov. 22, 2005

(54) WRAPPING MATERIAL DISPENSER SYSTEM

(76) Inventor: Keith Hayden, 53 Redbud Rd., Piscataway, NJ (US) 08854

( * ) Notice: Subject to any disclaimer, the term of this patent is extended or adjusted under 35 U.S.C. 154(b) by 284 days.

(21) Appl. No.: 10/198,910

(22) Filed: Jul. 19, 2002

(51) Int. Cl.[7] ..... B26F 3/02
(52) U.S. Cl. ..... 225/39; 225/53
(58) Field of Search ..... 225/39, 44, 45, 225/46, 47, 48, 49, 50, 53, 77, 80, 89, 90, 225/91; D9/414, 416, 437

(56) References Cited

U.S. PATENT DOCUMENTS

| | | | | | |
|---|---|---|---|---|---|
| 450,168 | A | * | 4/1891 | Loff | 225/89 |
| 1,881,731 | A | * | 10/1932 | Lewandowski | 225/44 |
| 2,614,015 | A | * | 10/1952 | McGehee | 225/53 |
| 2,799,393 | A | * | 7/1957 | Klein | 225/47 |
| 3,698,548 | A | * | 10/1972 | Stenzel et al. | 225/48 |
| 3,739,964 | A | * | 6/1973 | Stine | 225/47 |
| 3,771,700 | A | | 11/1973 | Garr | |
| 4,119,251 | A | * | 10/1978 | Golner et al. | 225/47 |
| 4,291,516 | A | | 9/1981 | Warner et al. | |
| 4,772,355 | A | * | 9/1988 | Leahy | 225/39 |
| 4,796,792 | A | | 1/1989 | Nelson et al. | |
| 4,972,984 | A | * | 11/1990 | Frank et al. | 225/48 |

* cited by examiner

*Primary Examiner*—Stephen Choi

(57) ABSTRACT

A wrapping material dispenser system for providing a dispensing unit with cutting members on both sides without having to lift and turn the dispensing unit. The wrapping material dispenser system includes a housing that has a bottom wall and a perimeter wall for extending upwardly from the bottom wall. A top portion is operationally coupled to the housing. The top portion and the housing defines an interior space. The top portion has a slit that extends therethrough. The top portion has a longitudinal axis. The slit is positioned such that a longitudinal axis of the slit has a parallel relationship with the longitudinal axis of the top portion. A quantity of wrapping material positioned within the interior space. The wrapping material has a first end that extends through the slit facilitating grasping the first end.

2 Claims, 4 Drawing Sheets

WRAPPING MATERIAL DISPENSER SYSTEM

BACKGROUND OF THE INVENTION

1. Field of the Invention

The present invention relates to dispensing systems and more particularly pertains to a new wrapping material dispenser system for providing a dispensing unit with cutting members on both sides without having to lift and turn the dispensing unit.

2. Description of the Prior Art

The use of dispensing systems is known in the prior art. U.S. Pat. No. 3,771,7000 describes a wrapping table attachment with a cutting blade for dispensing sheet material. Another type of dispensing systems is U.S. Pat. No. 4,796,796 and U.S. Pat. No. 4,291,516 describe an additional means for dispensing an cutting sheet material.

While these devices fulfill their respective, particular objectives and requirements, the need remains for a system that includes dual cutting surfaces and corner holes as described.

SUMMARY OF THE INVENTION

The present invention meets the needs presented above by incorporating dual cutting surfaces and corner holes.

Another object of the present invention is to provide a new wrapping material dispenser system that allows two users at opposite sides of a work surface to utilize one roll of wrapping material at the same time.

Still another object of the present invention is to provide a new wrapping material dispenser system that would save the user time and allow them to more efficiently utilize their work space.

To this end, the present invention generally comprises a housing that has a bottom wall and a perimeter wall for extending upwardly from the bottom wall. A top portion is operationally coupled to the housing. The top portion and the housing defines an interior space. The top portion has a slit that extends therethrough. The top portion has a longitudinal axis. The slit is positioned such that a longitudinal axis of the slit has a parallel relationship with the longitudinal axis of the top portion. A quantity of wrapping material positioned within the interior space. The wrapping material has a first end that extends through the slit facilitating grasping the first end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
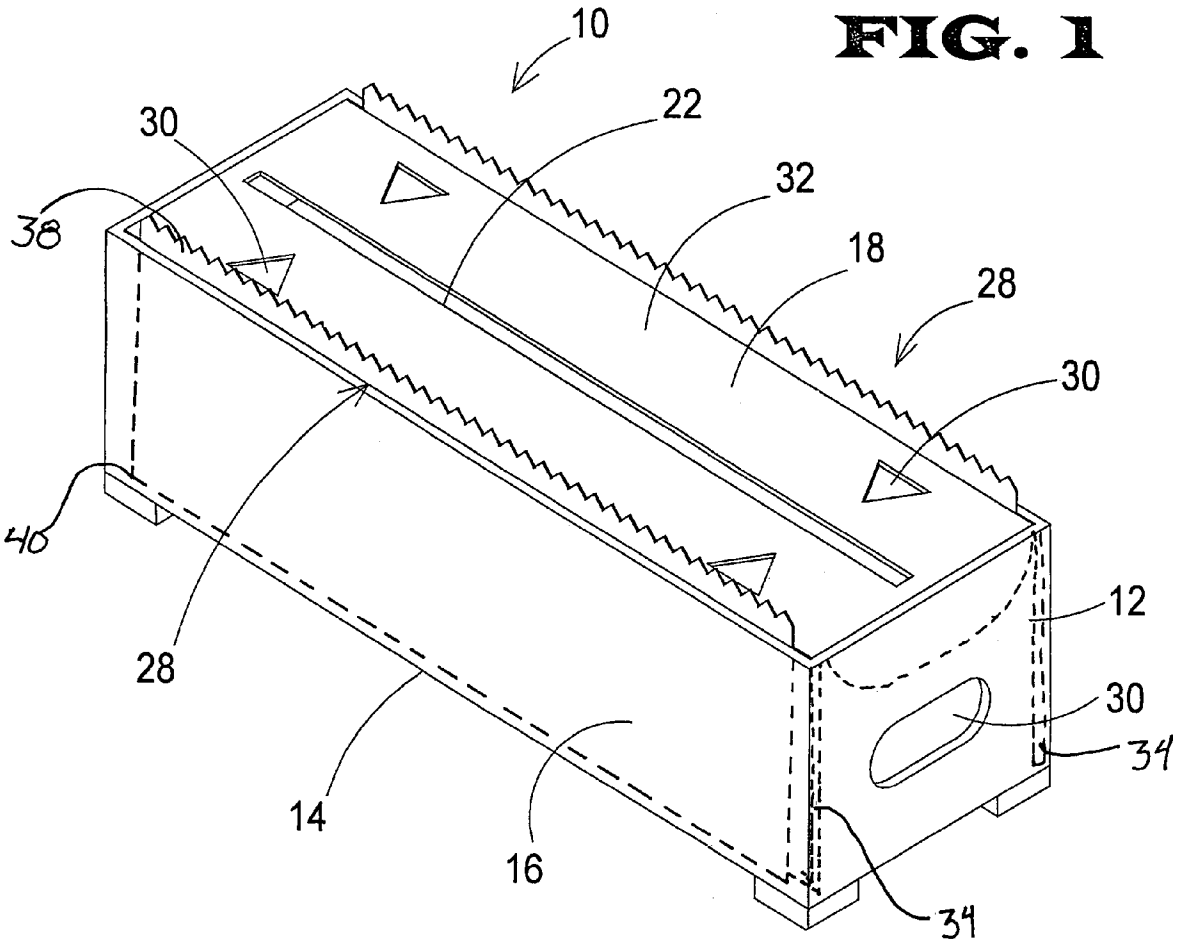
FIG. 1 is a perspective view of a new wrapping material dispenser system according to the present invention.
Figure 2:
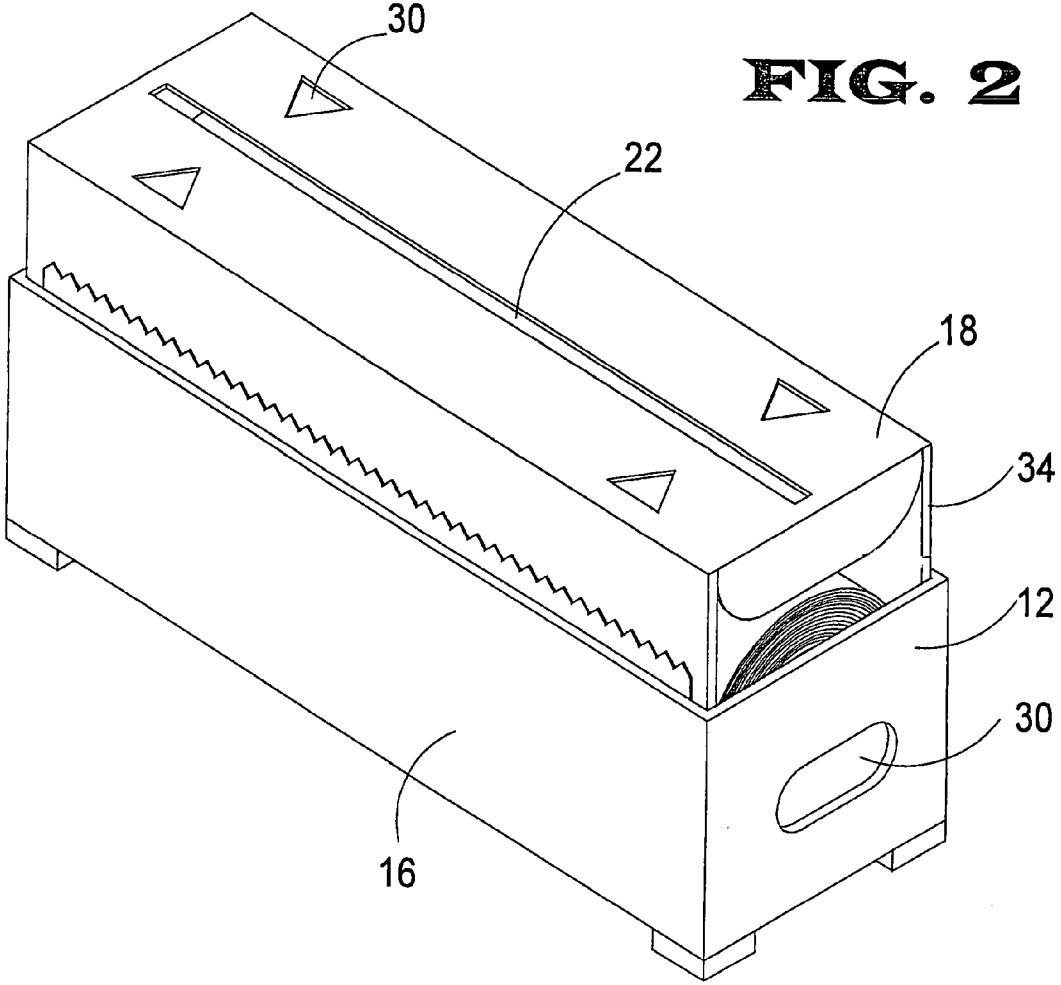
FIG. 2 is a exploded view of the present invention.
Figure 3:
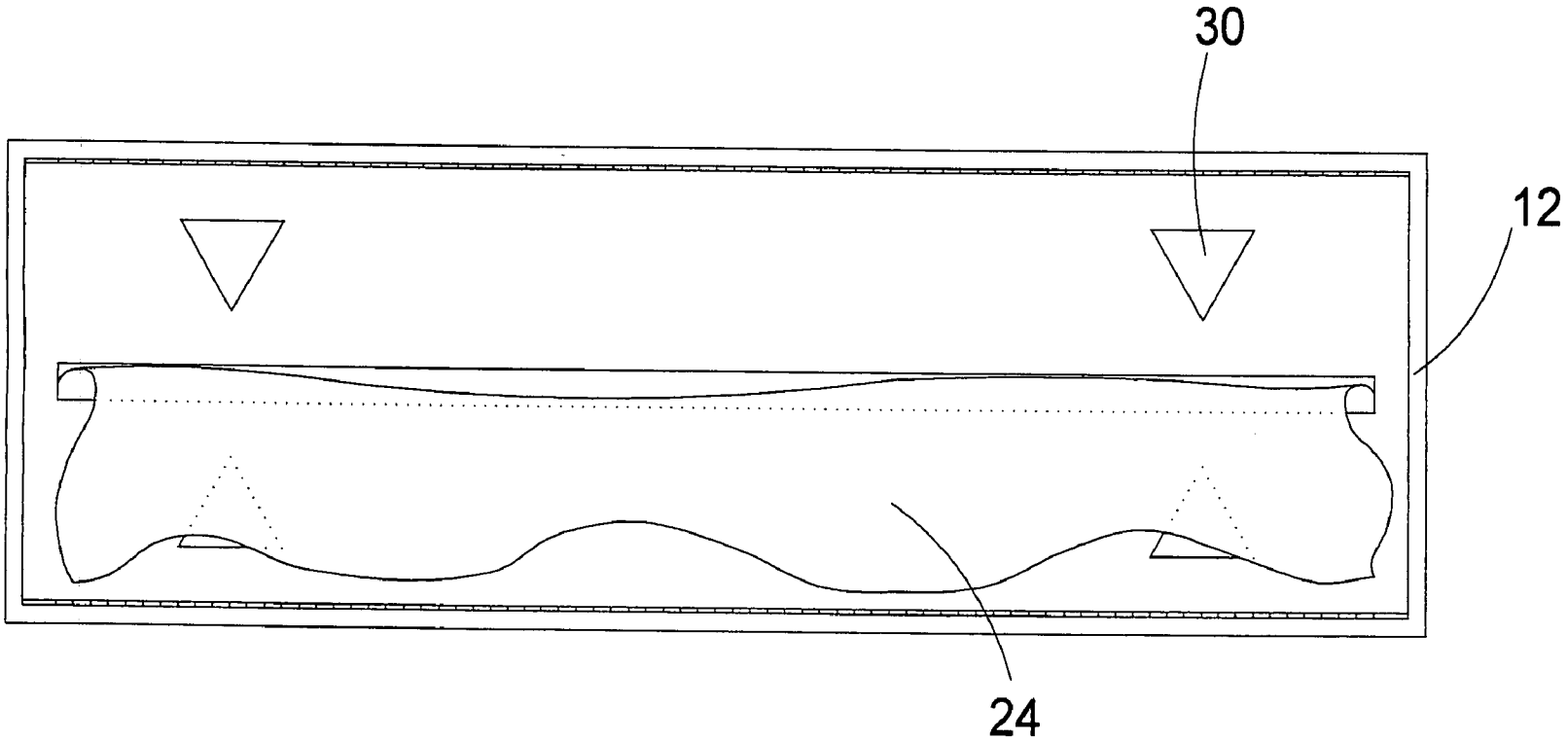
FIG. 3 is a top view of the present invention.
Figure 4:
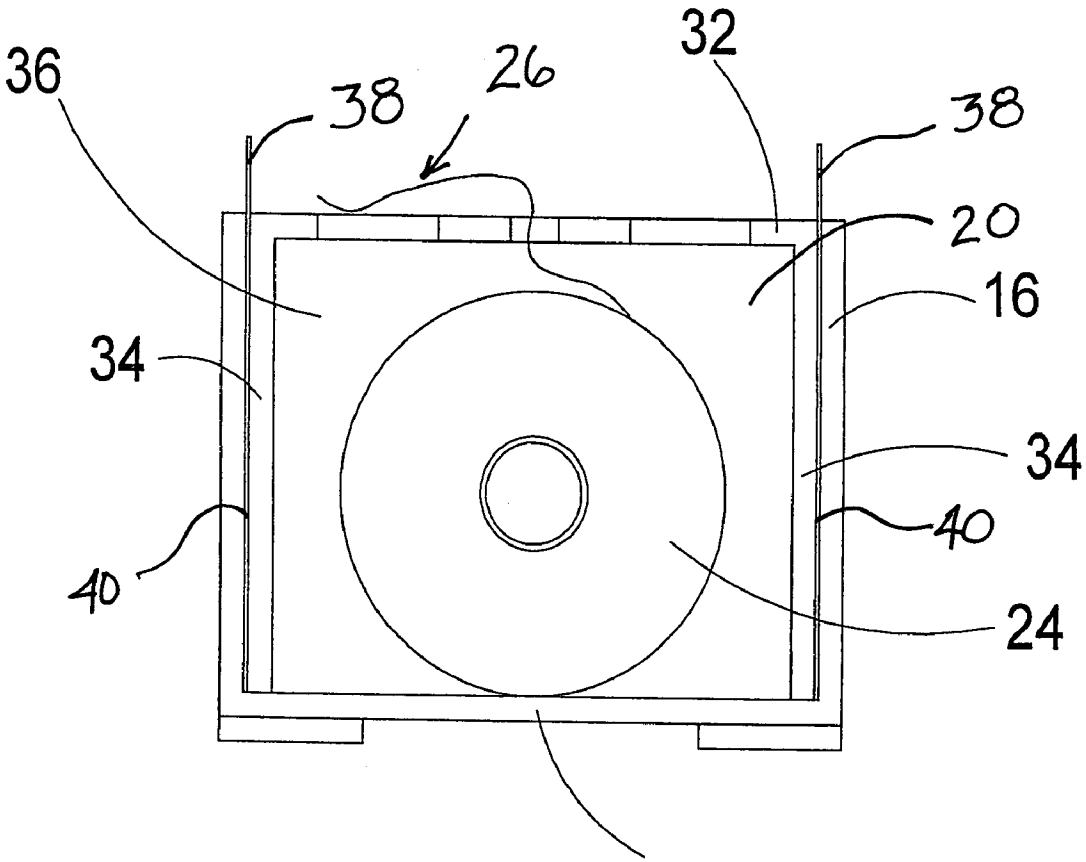
FIG. 4 is a cross-sectional view of the present invention.

With reference now to the drawings, and in particular to FIGS. 1 through 4 thereof, a new wrapping material dispenser system embodying the principles and concepts of the present invention and generally designated by the reference numeral 10 will be described.

As best illustrated in FIGS. 1 through 4, the wrapping material dispenser system 10 generally comprises a housing 12 that has a bottom wall 14 and a perimeter wall 16 for extending upwardly from the bottom wall 14. A top portion 18 is operationally coupled to the housing 12. The top portion 18 and the housing 12 define an interior space 20. The top portion 18 has a slit 22 that extends therethrough. The top portion 18 has a longitudinal axis, the slit 22 is positioned such that a longitudinal axis of the slit 22 has a parallel relationship with the longitudinal axis of the top portion 18. A quantity of wrapping material 24 is positioned within the interior space 20. The wrapping material 24 has a first end 26 that extends through the slit 22 facilitating grasping the first end 26.

A pair of cutter assemblies 28 are for cutting the wrapping material 24 to a desired length. Each one of the cutter assemblies 28 is positioned adjacent to an associated side of the slit 22. Each one of the cutter assemblies 28 has a longitudinal axis, each one of the cutter assemblies 28 is positioned such that the longitudinal axis has a parallel relationship with a longitudinal axis of the top portion 18. Each one of the pair of cutter assemblies 28 is operationally coupled to the top portion 18.

A plurality of finger holes 30 extend through the top portion 18. Each one of the plurality of finger holes 30 facilitate engaging the wrapping material 24 by a finger of a user. The plurality of finger holes 30 includes four finger holes 30. Each one of the finger holes 30 is positioned adjacent to an associated corner of the top portion 18.

The top portion 18 further includes a top wall 32 and a pair of side walls 34. The side walls 34 are positionable to abut an interior surface 36 of the perimeter wall 16 of the housing 12. The pair of the walls provide stability for the top wall 32. The pair of side walls 34 facilitate holding the top portion 18 in a relatively static position relative to the housing 12.

Each one of the pair of cutter assemblies 28 further includes a blade portion 38 and an insert portion 40. The insert portion 40 is positionable between the perimeter wall 16 and an associated side wall 34 of the top portion 18. The insert portion 40 facilitating holding the blade portion 38 in a relatively static position relative to the slit 22 facilitating cutting the wrapping material 24 to a desired length by pulling the wrapping material 24 across the blade portion 38.

The system has an overall length of 20⅛ inches, a width of 6½ inches, and a depth of 5¾ inches.

In use, a user would grasp a first side of the wrapping material and pull to the desired length. The user would then move the wrapping material to the desired cutting blade portion and the wrapping material would be cut to the desired length.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrapping material dispenser system comprising:

a housing having a bottom wall and a perimeter wall extending upwardly from said bottom wall;

a top portion operationally coupled to said housing, said top portion and said housing defining an interior space, said top portion having a slit extending therethrough, said top portion having a longitudinal axis, said slit 8 being positioned such that a longitudinal axis of said slit having a parallel relationship with said longitudinal axis of said top portion;

a quantity of wrapping material positioned within said interior space, said wrapping material having a first end extending through said slit facilitating grasping said first end;

a pair of cutter assemblies for cutting said wrapping material to a desired length, each one of said cutter assemblies being positioned adjacent to an associated side of said slit, each one of said cutter assemblies having a longitudinal axis, each one of said cutter assemblies being positioned such that said longitudinal axis has a parallel relationship with a longitudinal axis of said top portion, each one of said pair of cutter assemblies being operationally coupled to said top portion;

a plurality of finger holes extending through said top portion, each one of said plurality of finger holes facilitating engaging said wrapping material by a finger of a user; and wherein said plurality of finger holes comprises four finger holes, each one of said finger holes being positioned adjacent to an associated corner of said top portion;

wherein said top portion further comprises a top wall and a pair of side walls, said side walls being positionable to abut an interior surface of said perimeter wall of said housing, said pair of said walls providing stability for said top wall, said pair of side walls facilitating holding said top portion in a relatively static position relative to said housing; and wherein each one of said pair of cutter assemblies further comprises a blade portion and an insert portion, said blade portion extending above said top portion facilitating cutting said wrapping material to a desired length by pulling said wrapping material across said blade portion; said insert portion being operationally coupled to said blade portion, said insert portion positionable between said perimeter wall and an associated side wall of said top portion, said insert portion facilitating holding said blade portion in a relatively static position relative to said slit, said insert portion providing support for said blade portion while allowing said cutter assembly to be removed from said hosing without removing said top portion facilitating changing said cutter assembly.

2. The system of claim 1, wherein said system has an overall length of 20⅛ inches, a width of 6½ inches, and a depth of 5¾ inches.

* * * * *